US010647390B2

(12) United States Patent
Bech et al.

(10) Patent No.: US 10,647,390 B2
(45) Date of Patent: May 12, 2020

(54) BUOY DEVICE

(71) Applicant: Can Systems AS, Arendal (NO)

(72) Inventors: Arild Bech, Arendal (NO); Eirik Storvoll, Arendal (NO)

(73) Assignee: CAN SYSTEMS AS, Arendal (NO)

( * ) Notice: Subject to any disclaimer, the term of this patent is extended or adjusted under 35 U.S.C. 154(b) by 0 days.

(21) Appl. No.: 16/300,308

(22) PCT Filed: May 9, 2017

(86) PCT No.: PCT/NO2017/050113
§ 371 (c)(1),
(2) Date: Nov. 9, 2018

(87) PCT Pub. No.: WO2017/196182
PCT Pub. Date: Nov. 16, 2017

(65) Prior Publication Data

US 2019/0112007 A1 Apr. 18, 2019

(30) Foreign Application Priority Data

Jun. 14, 2016 (NO) ..... 20160999

(51) Int. Cl.
*B63B 22/02* (2006.01)
*B63B 3/08* (2006.01)

(52) U.S. Cl.
CPC ..... *B63B 22/02* (2013.01); *B63B 3/08* (2013.01); *B63B 22/021* (2013.01); *B63B 22/026* (2013.01)

(58) Field of Classification Search
CPC ..... B63B 22/02; B63B 22/021; B63B 22/026; B63B 3/08
See application file for complete search history.

(56) References Cited

U.S. PATENT DOCUMENTS 5,564,957 A 10/1996 Breivik et al.
2008/0035046 A1* 2/2008 Poscich ..... B63B 35/71 114/347

FOREIGN PATENT DOCUMENTS

| | | | |
|---|---|---|---|
| EP | 0 079 631 | A1 | 5/1983 |
| EP | 1 506 920 | A1 | 2/2005 |
| GB | 2 050 955 | A | 1/1981 |
| GB | 2 350 342 | A | 11/2000 |
| WO | WO 93/22190 | A1 | 11/1993 |
| WO | WO 00/73133 | A1 | 12/2000 |
| WO | WO 2009/031971 | A1 | 3/2009 |
| WO | WO 2011/042535 | A1 | 4/2011 |

(Continued)

OTHER PUBLICATIONS

International Search Report and Written Opinion dated Aug. 14, 2017 issued in International Application No. PCT/NO2017/050113.

(Continued)

*Primary Examiner* — Stephen P Avila
(74) *Attorney, Agent, or Firm* — Arent Fox LLP

(57) ABSTRACT

A buoy device includes a first part having a first support structure and a second part having a buoyant body and a second support structure. The first and second support structures are connectable to form a rotatable connection between the first part and the second part. The buoyant body further includes one or more buoyancy elements releasably arranged on the second part. The buoy device may be a turret buoy, a CALM turret buoy, or a CALM turntable buoy.

14 Claims, 5 Drawing Sheets

(56) References Cited

FOREIGN PATENT DOCUMENTS

| | | | |
|---|---|---|---|
| WO | WO 2014/103557 | A1 | 7/2014 |
| WO | WO 2014/180687 | A1 | 11/2014 |

OTHER PUBLICATIONS

Norwegian Search Report dated Jan. 10, 2017 issued in Norwegian Application No. NO20160999.
Norwegian Search Report dated Nov. 18, 2016 issued in Norwegian Application No. NO20160788.

* cited by examiner

BUOY DEVICE

CROSS-REFERENCE TO RELATED APPLICATIONS

This application is a 35 U.S.C. § 371 National Phase of PCT Application No. PCT/NO2017/050113 filed May 9, 2017, which claims priority to Norwegian Application Numbers NO 20160788 filed May 10, 2016 and NO 20160999 filed Jun. 14, 2016. The disclosures of these prior applications are hereby incorporated by reference herein.

FIELD OF THE INVENTION

The invention concerns a buoy device as set out by the preamble of claim 1, and methods of assembling the buoy device, as set out by the preamble of claims 12 and 13.

BACKGROUND OF THE INVENTION

In the production of hydrocarbons from offshore wells in deep seas, so-called Floating Production, Storage and Offloading (FPSO) ships, or similar concepts, are widely used. Ships of this type often rely on disconnectable turret buoy systems, both for mooring and as a means for connecting to the hydrocarbon risers. In general terms, the known turret buoy systems comprise a turret and a buoyant body, where the buoyant body is configured for connection to a receptacle in the vessel (e.g. the FPSO), and the turret is rotatably arranged inside the buoyant body via bearings (slewing bearings or sliding bearings). The turret has connectors for mooring lines and support hang-off structures for risers. Other variants, employing basically the same principle, are known within the industry.

Thus, when the buoyant body is connected to the vessel and the turret is moored to the seabed, the vessel is allowed to weathervane due to the rotational connection between the buoyant body and the turret. The weathervaning capability is often advantageous, as it significantly expands the operational envelope for the vessel.

Another favourable feature of the turret buoy mooring systems is the ability to quickly disconnect (and re-connect) the turret buoy and the vessel. The buoyant body is provided with buoyancy chambers and provides support to the turret (including the risers and mooring lines) when the turret buoy is disconnected. The buoyancy chambers are dimensioned to match the weight of the risers and mooring lines to ensure buoyancy equilibrium at a required submerged depth.

The prior art includes WO 93/22190, which describes a buoy for use in loading or unloading of a flowable medium, especially oil, comprising an outer buoyancy member arranged to be introduced and secured in a submerged downwardly open receiving space in a floating vessel, and a central member which is rotatably mounted in the outer member and is intended for anchoring to the sea bed and arranged for passage of medium between a transfer line which, in operation, is coupled to the lower end of the central member and a tube system on the vessel. The central member is provided with a lower extension body having an outer peripheral portion abutting on and essentially corresponding to the outer periphery of the adjacent end of the outer buoyancy member, and having a lower portion which is downwardly tapering from the outer peripheral portion. A number of fastening means for fastening of the upper ends of anchoring lines for anchoring of the buoy are fastened at intervals along the periphery of the outer peripheral portion of the extension body, and the extension body comprises at least one buoyancy chamber for buoyancy or ballast material.

The prior art also includes WO 2009/031971, which describes a mooring system for a vessel and a method of mooring a vessel. The mooring system comprises a turret structure; a swivel unit mounted on the turret structure; a bearing assembly for rotatably mounting the turret structure at deck level of the vessel such that the turret structure extends into a moonpool of the vessel and such that the swivel unit is disposed above deck level; a plurality of conduits for fluid communication disposed in the turret structure; a buoy structure, with internal buoyancy compartments, retrievable into the moonpool of the vessel and connectable to the turret structure; a locking assembly for mechanically locking the buoy structure to the turret structure. The turret structure is rotatable as one to align the conduits to corresponding riser valve structures on the buoy structure prior to mechanically locking the buoy structure to the turret structure.

Another buoy device employing basically the same principles as the above mentioned turret buoy, is the Catenary Anchor Leg Mooring (CALM) buoy. The CALM buoy is a floating hull with a rotating head to which vessels can moor. The CALM buoy falls under the category of a Single Point Mooring (SPM) typically with a turntable or turret positioned above the geostationary hull mounted on a bearing (e.g. slewing bearing or sliding bearing). Flexible large bore rubber hoses are used to connect the subsea pipeline to the hull. Similar floating hoses are employed when connecting the buoy to a tanker prior to transferring liquid hydrocarbons. Central to the main bearing is a product swivel which allows fluid to transfer between the geostationary hull and rotating turntable while the moored vessel weathervanes.

The prior art includes WO 2014/180687 A1, which shows a mooring system comprising an external turret (to which a production vessel is moored) from which a buoyant body may be connected and disconnected.

The prior art also includes WO 2011/042535 A1, which discloses a CALM buoy having a floating body anchored to the sea bed via two or more anchor lines. The floating body comprises a lower part to be situated below water level and an upper part to be situated above water level. A turntable is rotatably attached to the floating body upper part via a bearing, the turntable comprising mooring points and fluid transfer means. The floating body is a circular hull, having internal buoyancy chambers.

Although the turret buoy and the CALM buoy to some extent have different technical features and are used for different purposes, they rely on the common principle that one part is moored to the seabed (i.e. more or less geostationary) and another part is connectable to a ship, and the two parts are rotatably connected. For example, in the turret buoy and the CALM turret buoy described above, the geostationary part is the turret and the buoyant body is connected to the ship. By contrast, in a CALM buoy having a turntable, the buoyant body is moored to the seabed, while the turntable is connected to the ship.

Known buoy devices of the kind described above are large, heavy, structures, with heights on the order of 10 to 15 metres and maximum diameters up to 15 metres. As the buoys must be designed with a certain degree of contingency, i.e. in the event one or more of the buoyancy chambers are compromised (e.g. as a result of collision or dropped objects), the known buoys normally have several buoyancy chambers, separated by internal bulkheads. This adds weight and fabrication time. Typical dry weights range between 100 and 1500 Tonnes. Time, equipment, and manpower (and hence cost) required to construct, transport and install known buoy devices are therefore considerable. It is an object of the invention to present a buoy which alleviates at least some of the disadvantages with the prior art.

SUMMARY OF THE INVENTION

The invention is set forth and characterized in the main claim, while the dependent claims describe other characteristics of the invention.

It is thus provided a buoy device comprising a first part having a first support structure; a second part having buoyancy means and a second support structure; and the first and second support structures are connectable via rotation and support means to form a rotatable connection between the first part and the second part; characterized in that

- the buoyancy means comprises a plurality of buoyancy elements;
- the second support structure comprises a base member configured to support the buoyancy elements; and
- the buoyancy elements comprise locking means for releasably locking the buoyancy elements to each other and/or to the second part.

In one embodiment, the second support structure comprises a central column, and the buoyancy elements are arranged around the central column.

In one embodiment, the buoyancy element's inner side has a curved surface, corresponding to and complementary with the cylindrical surface of the central column.

The buoyancy element may comprise a stiff outer shell, enclosing one or more internal buoyancy tanks.

The buoyancy element may comprise a buoyant material covered by an outer casing. The buoyant material may comprise polyurethane foam. The outer casing may for example comprise a fibreglass (e.g. GRP) shell, or a shell of another light-weight material.

The buoy device further comprises locking means for releasably locking the buoyancy elements to each other and/or to the second part.

In a first embodiment, the first part comprises mooring connectors, configured for connection to anchor chains or lines, by means of which the first part may be moored to a seabed; and the second, buoyant, part comprises connection means whereby the second part may be releasably connected to a vessel, such as a ship. The buoy device may in this embodiment be a turret buoy and the first part a turret. In one embodiment, the second, buoyant, part comprises an upper deck structure and ship interface devices.

It is also provided a method of assembling the buoy device according to the first embodiment of the invention, characterized by the steps of:

a) placing the first part on a support structure;
b) lifting the second part above the first part and joining the first and second support structures to form a rotatable connection between the first part and the second part;
c) placing at least one buoyancy element on the second part; and
d) securing the buoyancy elements to the second part.

In a second embodiment, the second, buoyant, part may comprise mooring connectors, configured for connection to anchor chains or lines, by means of which the second part may be moored to a seabed; and the first part may comprise connection means whereby the second part may be releasably connected to a vessel, such as a ship. The buoy device may in this embodiment be a Catenary Anchor Leg Mooring (CALM) buoy and the first part a turntable.

It is also provided a method of assembling the buoy device according to the second embodiment of the invention, characterized by the steps of:

a) placing the second part on a support structure, for example a vessel deck;
b) placing at least one buoyancy element on the second part;
c) securing the buoyancy element to the second part; and
d) lifting the first part above the second part and lowering the first part onto second part support and rotation means.

The invented buoy device is considerably lighter that the known buoys, and provides several advantages over the prior art:

- It is not necessary to design with a contingency for damaged buoyancy chambers. The foam-filled buoyancy module does not lose its buoyancy even if its outer shell is punctured. If, however, a buoyancy module is damaged, it can be replaced by another buoyancy module stored. Spare buoyancy modules may be stored on board the vessel, or may be shipped in as and when required.
- Buoy fabrication is faster and less costly. The buoyancy modules may be prefabricated in various shapes, quantities, and with the desired buoyancy characteristics. Extensive welding of buoyancy chambers; internal bulkheads, etc. is avoided. Leak testing is not required, and the total fabrication time is significantly reduced.
- Lifting weights during assembly is significantly reduced, particularly when lifting the buoy is to be lifted onto the turret, because the buoyancy elements can be assembled when the buoy (i.e. column) and turret have been interconnected. Final assembly (i.e. installing the buoyancy elements) can be performed anywhere, e.g. on the mobilization site.
- Flexibility: buoyancy can be controlled and adjusted on site, by removing one or more buoyancy elements, or by installing buoyancy elements with lesser buoyancy.
- Fender members may be incorporated into the buoyancy elements.
- Requires fewer anodes (due to less steel used).

BRIEF DESCRIPTION OF THE DRAWINGS

These and other characteristics of the invention will become clear from the following description of preferential forms of embodiment, given as non-restrictive examples, with reference to the attached schematic drawings, wherein.

DETAILED DESCRIPTION OF A PREFERENTIAL EMBODIMENT

Figure 1:
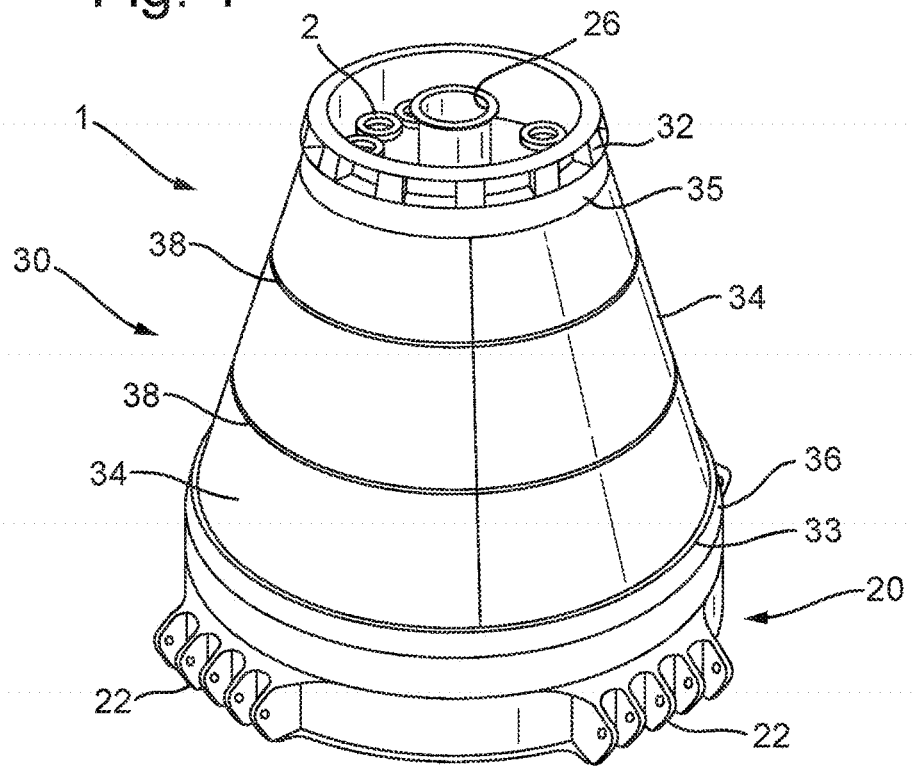
FIG. 1 is a perspective view of an embodiment of the invented turret buoy, in an assembled state.

The following description may use terms such as "horizontal", "vertical", "lateral", "back and forth", "up and down", "upper", "lower", "upwards", "downwards", "inner", "outer", "forward", "rear", etc. These terms generally refer to the views and orientations as shown in the drawings and that are associated with a normal use of the invention. The terms are used for the reader's convenience only and shall not be limiting.

Figure 4:
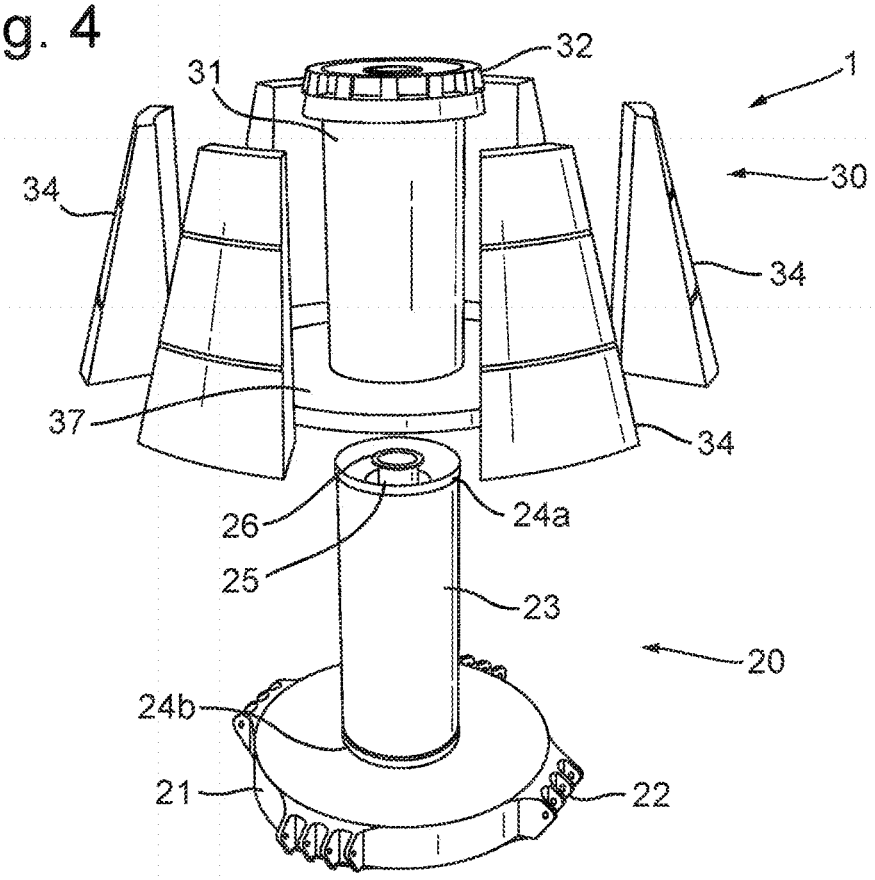
FIGS. 4 and 5 are exploded views of the embodiment illustrated in FIGS. 1-3.
Figure 5:
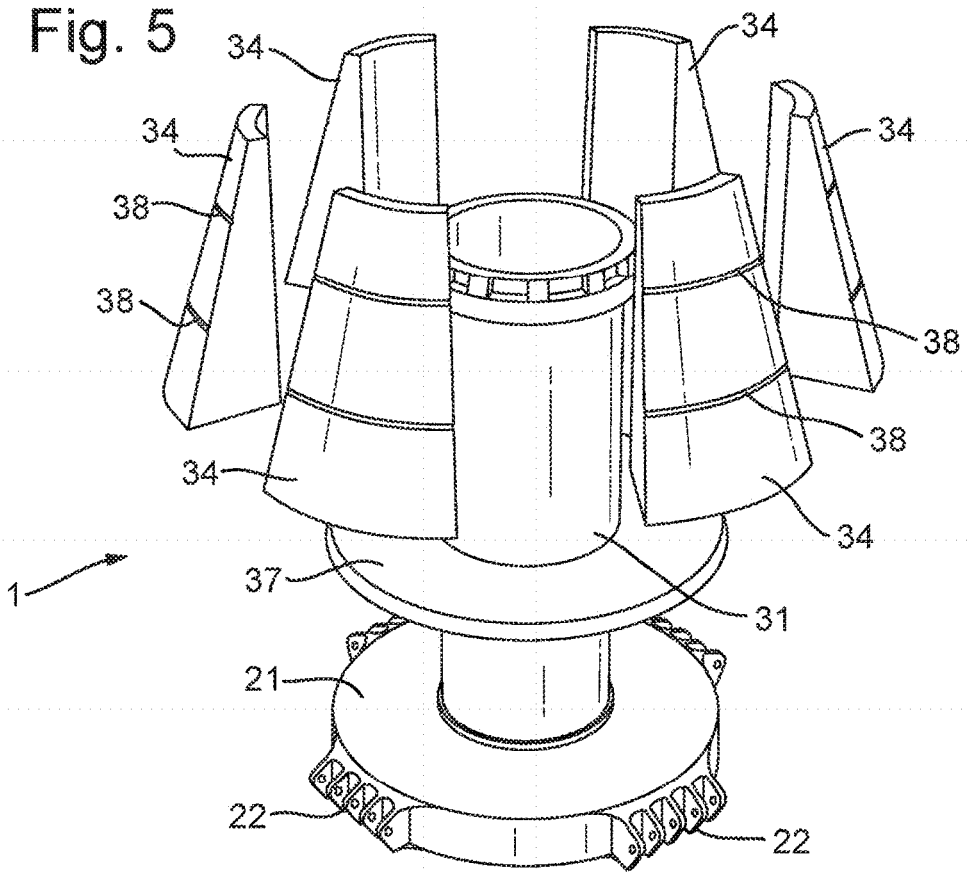

Referring initially to FIG. 4 and FIG. 5, the invented buoy device comprises in one embodiment a turret buoy 1 having a turret 20 and a buoyant body 30. The turret 20 comprises a base portion 21, having a plurality of mooring connectors 22 to which mooring lines or chains (not shown) may be attached. The figure shows a base portion having four groups of mooring connectors 22 arranged at regular intervals around the base portion perimeter, each group consisting of five mooring connectors. It should be understood that more or fewer mooring connectors and configurations may be used. The base portion 21 may also comprise internal ballast tanks (not shown). Extending upwards from the base portion 21 is a turret column 23 having an inner core 26. The annulus 25 between the inner core and the column inner wall is configured for accommodating and supporting risers (not shown in FIG. 4) in a manner which is well known in the art.

Figure 6:
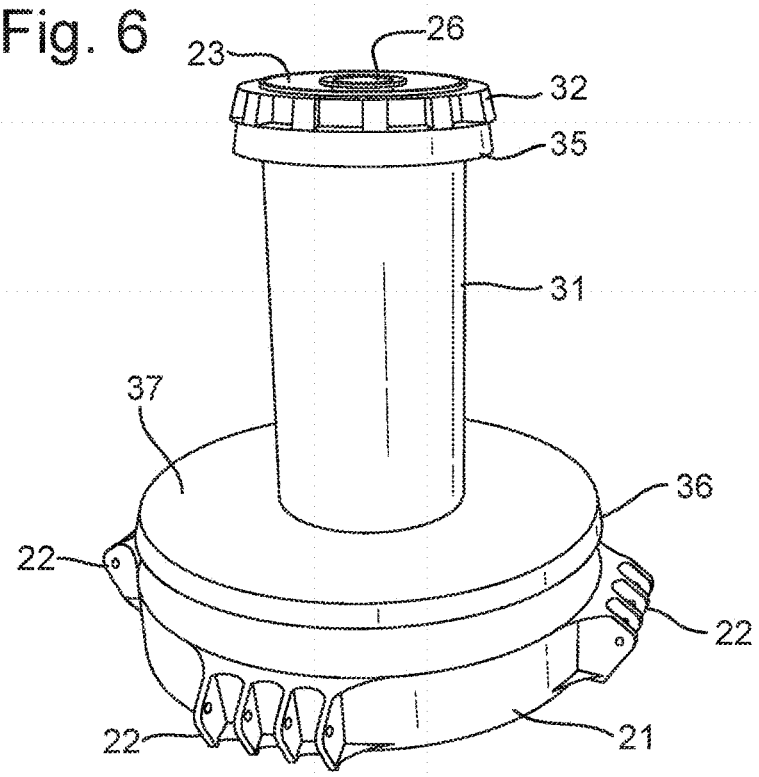
FIG. 6 is a perspective view of the embodiment illustrated in FIGS. 1-5, but where all buoyancy elements have been removed.

The buoyant body 30 comprises a base member 37, and a central column 31 extending upwards from the base member. The turret column 23 and central column 31 are dimensioned and configured such that the turret column 23 can be rotatably accommodated inside the central column 31, as illustrated in FIG. 6. Upper and lower bearings 24*a,b* are arranged on the turret column 23 and configured for rotatingly supporting the turret column 23 in the central column 31, and forming a rotatable (e.g. slewing or sliding) connection in which the turret 20 and buoyancy member 30 are allowed to rotate independently of one another. Such bearings are well known in the art. Required interlocking means are not illustrated, as such means are well known in the art and not part of the invention per se. Swivel connection between risers and other piping are also not illustrated, as such swivel connections are well known in the art.

The turret base portion 21, turret column 23, base member 37 and central column 31 may be manufactured from materials that are capable of withstanding the considerable forces involved in mooring a vessel, such as an FPSO ship. Suitable materials in that respect would be high-strength steel.

Arranged around the central column 31 is a plurality of buoyancy elements 34. In the illustrated embodiment, the buoyant body 30 holds six buoyancy elements 34, but it should be understood that the fewer or more buoyancy elements may be used.

The buoyancy elements 34 may be made of a buoyant material, such as polyurethane foam, and covered by a fibreglass (e.g. GRP) shell. A particular advantage of this variant is that buoyancy is not compromised even if the shell is punctured. Leak testing, which is necessary with the prior art, is not required, and the total fabrication time is significantly reduced, compared to the prior art. However, the buoyancy elements 34 may also be made of a stiff outer shell, enclosing one or more internal buoyancy tanks.

The individual buoyancy elements 34 may be prefabricated, and transported and installed on the mobilization site. It will be understood that the buoyancy elements may have other shapes than those illustrated.

FIG. 1 shows an assembled turret buoy, ready for installation in a vessel and connection to mooring lines. Reference numbers 32 and 33 indicate hull interface (i.e. contact) portions, where the buoyancy member 30 is connected to the vessel hull opening. In this configuration, the turret buoy 1 may be pulled into, and locked into, a corresponding recess in the vessel hull (not shown), in a manner which is well known in the art.

Figure 2:
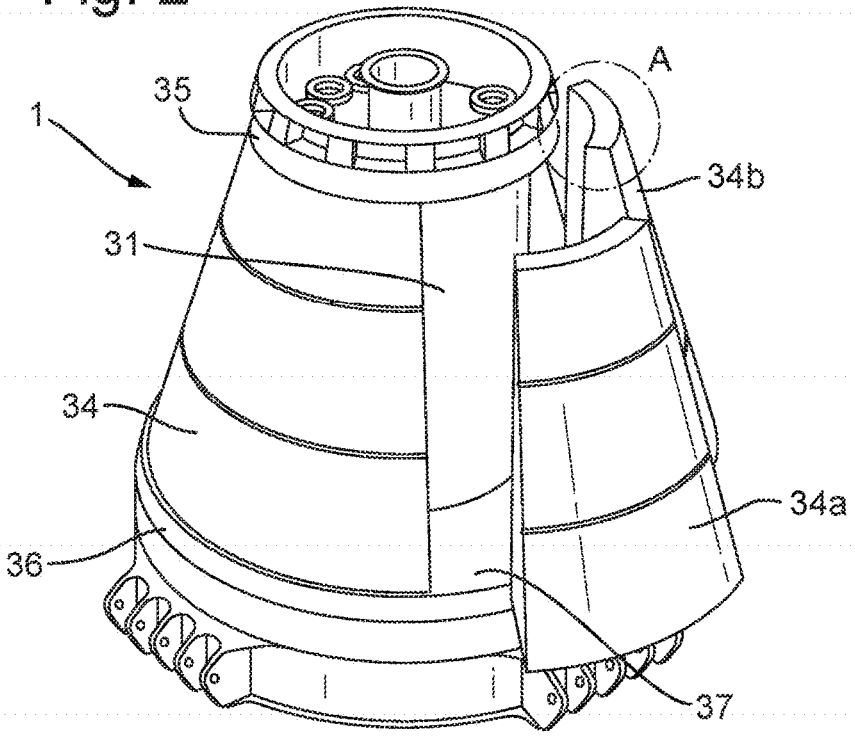
FIG. 2 is a perspective view of the embodiment illustrated in FIG. 1, but where two buoyancy elements have been detached from the turret buoy.
Figure 3:
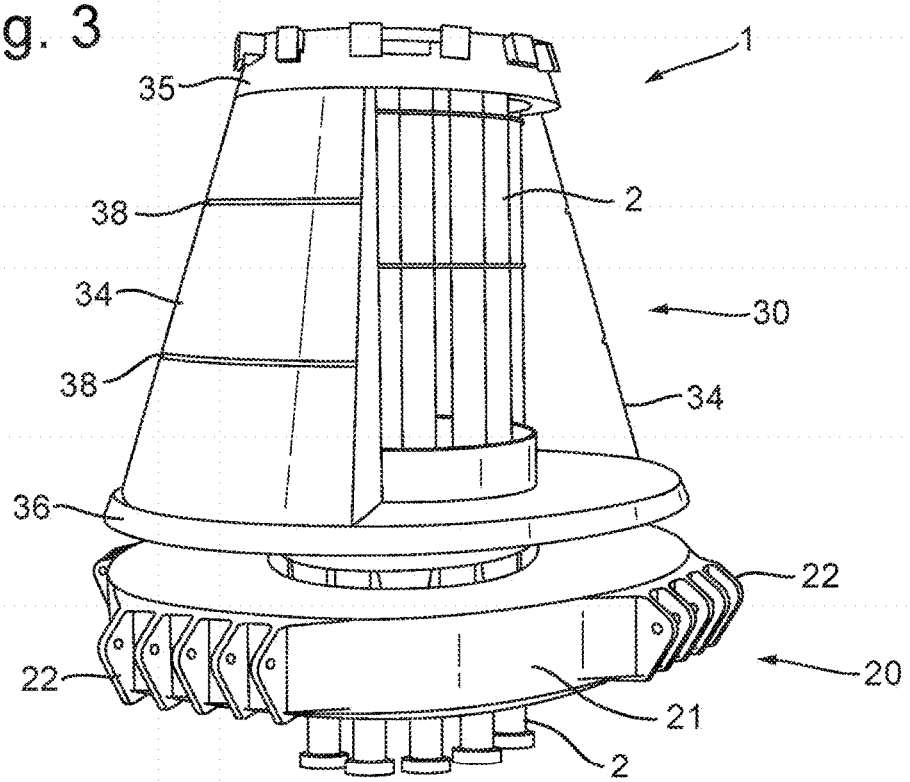
FIG. 3 is a perspective view of the embodiment illustrated in FIGS. 1 and 2, but where two buoyancy elements have been removed and a portions of the turret column and the buoy column have been cut away in order to display the risers being arranged inside the turret.

In FIG. 2, two buoyancy elements 34*a,b* have been detached from the turret buoy 1. In FIG. 3, two buoyancy elements have been removed and portions of the turret column 23 and the central column 31 has been cut away in order to illustrate how the risers 2 are arranged inside the turret 20. The risers 2 (only parts of which are shown in FIG. 3) are extended through, and suspended by, the turret 20 and connected to a swivel (not shown) in a manner which is well known in the art, and will therefore not be discussed here.

In the illustrated embodiment, each buoyancy element 34 is installed on the buoyant body 30 by placing the buoyancy elements side by side around the central column 31, the lower ends resting on the base member 37 and the inner sides bearing against the central column 31. As can be seen in the encircled area A in FIG. 2, the buoyancy element's inner side has a curved surface, corresponding to and complementary with the cylindrical surface of the central column 31. In the illustrated embodiment, the central column comprises a first retaining rim 35, arranged in the region of the top of the central column 31, and the base member 37 comprises a second retaining rim 36, arranged in the region of the base member perimeter. When installing a buoyancy element 34, therefore, the upper part may be inserted behind the first retaining rim 35 and lifted upwards such that the lower part of the buoyancy element may be moved across and behind the lower retaining rim 36, whereupon the buoyancy element is lowered into abutment with the base member. In the illustrated embodiment, each buoyancy element 34 is furnished with grooves 38 in which a suitable strap may be placed. By extending the strap around the buoyant body, all of the buoyancy elements may be strapped tightly to the central column 31. One example of a suitable strap is a Roblon® Clamp Strap, manufactured and sold by Roblon A/S. It should be understood that other fastening means and support means, as well as installation methods, are conceivable within the ambit of the invention. For example, each buoyancy element may be connected to its adjacent buoyancy element by means of individual clasps or turnbuckles.

The invented turret buoy may thus be fabricated in separate parts, and assembled by:

a) placing the turret 20 on a support structure, for example a vessel deck (not shown);
b) lifting the assembled central column 31 and base member 37 (i.e. the buoyant body without any buoyancy elements) above the turret column 23, and lowering the assembled central column 31 and base member 37 such that the turret column 23 is inserted into the central column 31 (see FIG. 6);
c) placing the required plurality of buoyancy elements 34 on the buoyant body 30 as described above (see FIG. 2); and d) securing the buoyancy elements 34 to the buoyant body 30 (see FIG. 1). A typical turret buoy according to the present invention, may have an overall height of 10 to 15 metres, a maximum diameter of about 15 metres and a total dry weight of 100 to 1000 tonnes or more; providing a net buoyancy in the range 100 to 1500 tonnes. The invention shall, however, not be limited to these dimensions.

Although not illustrated explicitly, it should be understood that the invented turret buoy easily may be modified into at CALM turret buoy. For example, the buoyant body 30, which in FIG. 1 is shown to have a frusto-conical shape, may be given a more cylindrical shape and/or be provided with an upper deck structure and the ship interface devices normally associated with such CALM turret buoys.

Figure 7:
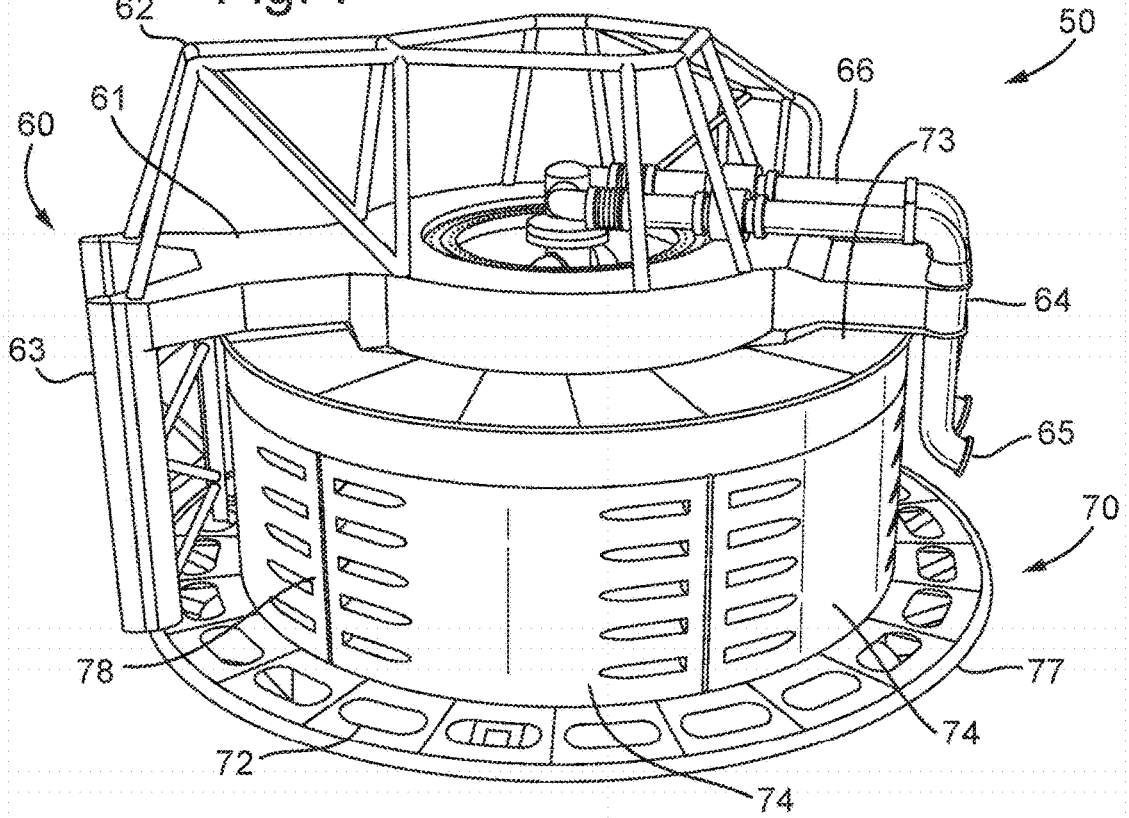
FIG. 7 is a perspective view of another embodiment of the invention, in the form of a turntable buoy.
Figure 8:
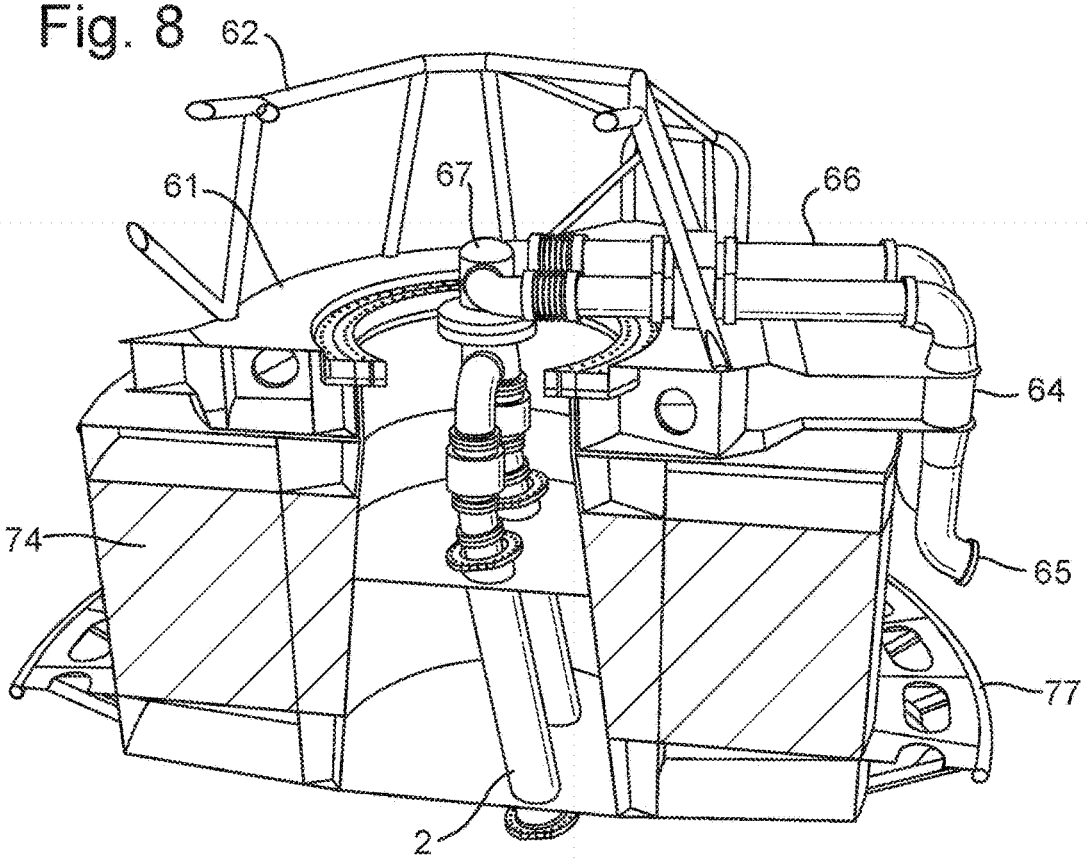
FIG. 8 is an off-center sectional drawing of the embodiment illustrated in FIG. 7.

Although the invention has been described above with reference to a turret buoy in which the turret is moored to the seabed (i.e. the "geostationary part") and the buoyant body is connected to the vessel—either as a turret buoy or as a CALM buoy, it should be understood that the invention is equally applicable to buoy systems in which the buoyant body is moored to the seabed. One example of such systems is the CALM buoy having a turntable, an embodiment of which will be described in the following with reference to FIGS. 7-9.

In the illustrated embodiment, the CALM turntable buoy 50 basically comprises a buoyant body 70 which is supporting a turntable 60.

The turntable 60 comprises a platform 61, hand rails 62 and a boat landing area 63 for providing access for personnel. On the opposite side from the boat landing area, a ship connection interface 64 is provided, via which a ship (e.g. an oil tanker) may be moored to the turntable via mooring lines (not shown), in a manner which per se is known in the art.

The buoyant body 70 comprises a base member 77, which is provided with mooring connectors 72, by means of which the base member may be connected to seabed anchors (not shown) via mooring lines in a manner which per se is known in the art. In the illustrated embodiment, the base member is a circular and disk-shaped, but the invention shall not be limited to such shape. Extending from the base member 77 is a central column 71, which in turn is connected to and supports a turntable support member 73. A turntable interface column 75 extends from the turntable support member 73 and is structurally an extension on the central column 71. A bearing 3 (see FIG. 9) is arranged around the turntable interface column 75. Risers 2 extend (from the seabed, not shown) through the central column 71 and are connected to fluid lines 66 via a swivel 67 (see FIG. 8), in a manner which per se in known in the art. The fluid lines 66 terminate in a fluid line connection interface 66, to which loading hoses (not shown) may be connected.

The turntable 60, base member 77, central column 71, turntable support member 73 and turntable interface columns 75 may be manufactured from materials that are capable of withstanding the considerable forces involved in mooring a vessel. Suitable materials in that respect would be high-strength steel.

Arranged around the central column 71 is a plurality of buoyancy elements 74. In the illustrated embodiment, the buoyant body 70 holds six buoyancy elements 74, but it should be understood that the fewer or more buoyancy elements may be used.

The buoyancy elements 74 may be made of a buoyant material, such as polyurethane foam, and covered by a fibreglass (e.g. GRP) shell. A particular advantage of this variant is that buoyancy is not compromised even if the shell is punctured. Leak testing, which is necessary with the prior art, is not required, and the total fabrication time is significantly reduced, compared to the prior art. However, the buoyancy elements 74 may also be made of a stiff outer shell, enclosing one or more internal buoyancy tanks.

The individual buoyancy elements 74 may be prefabricated, and transported and installed on the mobilization site. It will be understood that the buoyancy elements may have other shapes than those illustrated.

Figure 9:
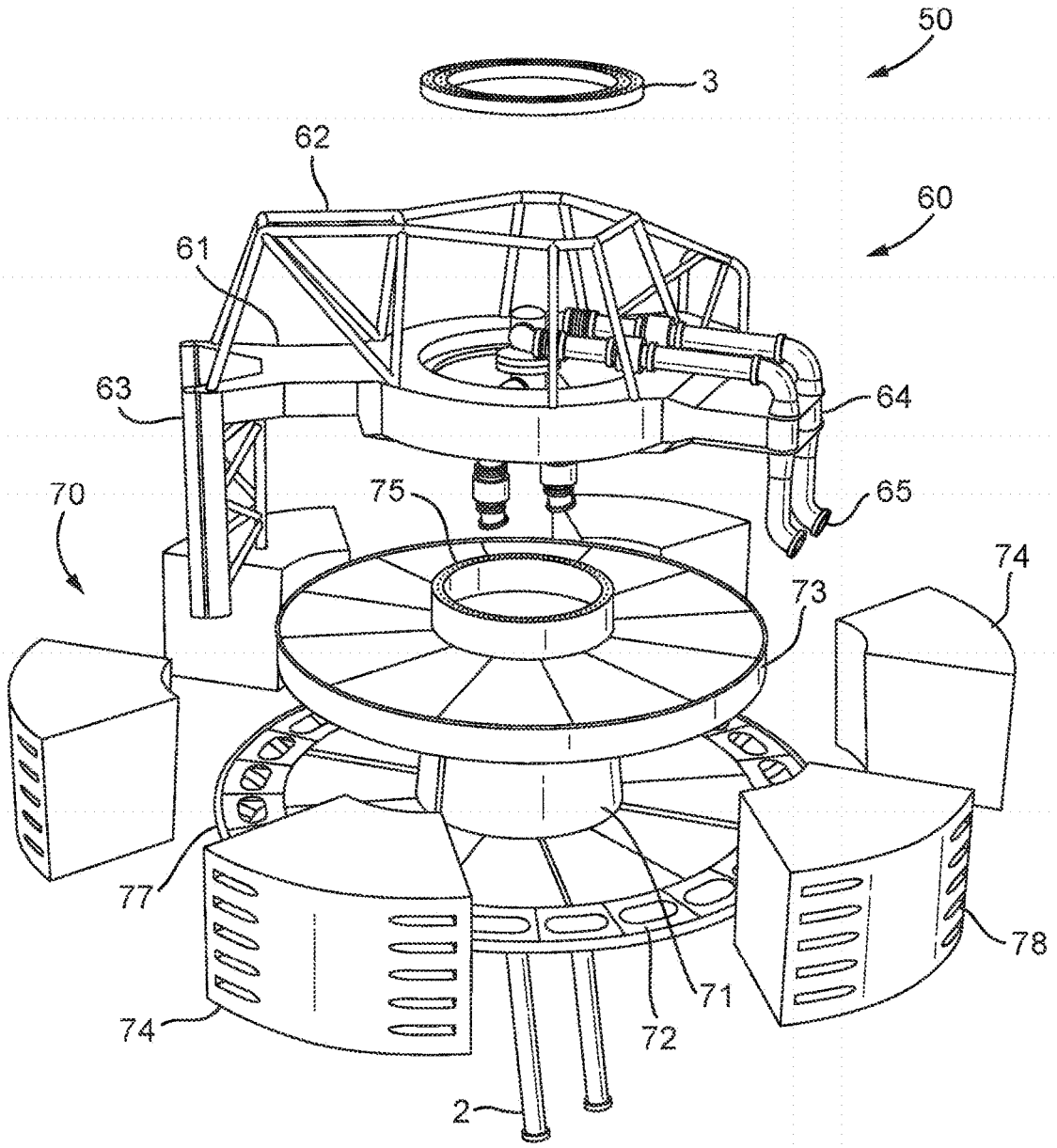
FIG. 9 is an exploded view of the embodiment illustrated in FIG. 7.

In the illustrated embodiment, each buoyancy element 74 is installed on the buoyant body 70 by placing the buoyancy elements side by side around the central column 71, the lower ends resting on the base member 77 and the inner sides bearing against the central column 71. As can be seen in FIG. 9, the buoyancy element's inner side has a curved surface, corresponding to and complementary with the cylindrical surface of the central column. In the illustrated embodiment, each buoyancy element 74 is furnished with recessed and tangentially oriented holes 78, by means of which adjacent buoyancy elements 74 may be interconnected (via bolts, or similar; not shown). Other fastening means, serving to fasten the buoyant bodies to the central column 71, may be used.

The invented turntable buoy may thus be fabricated in separate parts, and assembled by:

a) placing the buoyant body 70 on a support structure, for example a vessel deck (not shown);

b) placing the required plurality of buoyancy elements 74 on the buoyant body's base member 77;

c) securing the buoyancy elements 74 to the buoyant body 70; and d) lifting the turntable 60 above the buoyant body 70 and lowering the turntable onto the turntable support member 73 and turntable interface column 75.

The invention claimed is:

1. A buoy device, comprising:

a first part having a first support structure;

a second part having a buoyant body and a second support structure;

wherein the first support structure and the second support structure are connectable via rotation and support elements to form a rotatable connection between the first part and the second part;

wherein the buoyant body comprises a plurality of buoyancy elements;

wherein the second support structure comprises a base member configured to support the plurality of buoyancy elements, and a central column extending between a first end and a second end, wherein the base member extends from the central column at the second end, and the plurality of buoyancy elements are arranged around the central column and extend between the first end and the second end of the central column; and wherein the plurality of buoyancy elements comprise locking portions for releasably locking at least one of the plurality of buoyancy elements to at least another of the plurality of buoyancy elements.

2. The buoy device of claim 1, further comprising a first retaining rim at the first end of the central column and a second retaining rim at the second end of the central column, wherein the first retaining rim and the second retaining rim are configured to retain the plurality of buoyancy elements between the first end and the second end of the central column.

3. The buoy device of claim 1, wherein the plurality of buoyancy elements comprise inner sides that have a curved surface, corresponding to and complementary with a cylindrical surface of the central column.

4. The buoy device of claim 1, wherein the plurality of buoyancy elements comprise a stiff outer shell, enclosing one or more internal buoyancy tanks.

5. The buoy device of claim 1, wherein the plurality of buoyancy elements comprise a buoyant material covered by an outer casing.

6. The buoy device of claim 5, wherein the buoyant material comprises polyurethane foam.

7. The buoy device of claim 5, wherein the outer casing comprises a fibreglass shell.

8. The buoy device of claim 1, wherein the first part further comprises mooring connectors configured to be connected to anchor chains or lines for mooring to a seabed; and the second part comprises a connection portion, whereby the second part may be releasably connected to a vessel.

9. The buoy device of claim 8, wherein the buoy device is a turret buoy and the first part is a turret.

10. The buoy device of claim 8, wherein the second part comprises an upper deck structure and ship interface devices.

11. The buoy device of claim 1, wherein the second part further comprises mooring connectors, configured to be connected to anchor chains or lines for mooring the second part to a seabed; and the first part further comprises a connection portion, whereby the second part may be releasably connected to a vessel.

12. The buoy device of claim 11, wherein the buoy device is a Catenary Anchor Leg Mooring (CALM) buoy and the first part is a turntable.

13. A method of assembling a buoy device comprising: a first part having a first support structure; a second part having a buoyant body and a second support structure; wherein the first support structure and the second support structure are connectable via rotation and support elements to form a rotatable connection between the first part and the second part; wherein the buoyant body comprises a plurality of buoyancy elements; wherein the second support structure comprises a base member configured to support the buoyancy elements; and wherein the plurality of buoyancy elements comprise locking portions for releasably locking at least one of the plurality of buoyancy elements to at least one of: another of the plurality of buoyancy elements or the second part; the method comprising:

placing the first part on a support structure;

lifting the second part above the first part and joining the first and second support structures to form the rotatable connection between the first part and the second part;

placing at least one of the plurality of buoyancy elements on the second part; and securing the at least one of the buoyancy elements to the second part.

14. A method of assembling a buoy device comprising: a first part having a first support structure; a second part having a buoyant body and a second support structure; wherein the first support structure and the second support structure are connectable via rotation and support elements to form a rotatable connection between the first part and the second part; wherein the buoyant body comprises a plurality of buoyancy elements; wherein the second support structure comprises a base member configured to support the buoyancy elements; and wherein the plurality of buoyancy elements comprise locking portions for releasably locking at least one of the plurality of buoyancy elements to at least one of: another of the plurality of buoyancy elements or the second part; the method comprising:

placing the second part on a support structure;

placing at least one of the plurality of buoyancy elements on the second part;

securing the at least one of the plurality of buoyancy elements to the second part; and lifting the first part above the second part and lowering the first part onto a set of the support and rotation elements on the second part.

* * * * *